United States Patent [19]

Marse

[11] 4,118,036

[45] Oct. 3, 1978

[54] PRESIDENT ELECTION GAME

[76] Inventor: Salvador Marse, 320 S. Harrison St., East Orange, N.J. 07018

[21] Appl. No.: 789,098

[22] Filed: Apr. 20, 1977

[51] Int. Cl.[2] ..... A63F 3/04

[52] U.S. Cl. ..... 273/257; 273/239

[58] Field of Search ..... 273/257, 251, 252, 254

[56] References Cited

U.S. PATENT DOCUMENTS

| | | | |
|---|---|---|---|
| 2,930,621 | 3/1960 | Gross et al. | 273/257 |
| 3,318,601 | 5/1967 | MacLeod | 273/257 |
| 3,368,816 | 2/1968 | Milazzo et al. | 273/257 |
| 3,907,299 | 9/1975 | Kristen | 273/257 |

*Primary Examiner*—Richard C. Pinkham
*Assistant Examiner*—Harry G. Strappello
*Attorney, Agent, or Firm*—Leonard W. Suroff

[57] ABSTRACT

A presidential election game in which the fifty states and the District of Columbia are divided into color coordinated zones with a magnetized score device for each player to record the changing number of popular and/or electoral college votes that each player has accumulated until a winner is elected and becomes the President of The United States of America.

30 Claims, 12 Drawing Figures

PRESIDENT ELECTION GAME

BACKGROUND OF THE INVENTION

1. Field of the Invention:

This invention relates to a game and more particularly to an educational and entertaining game played on a board with movable pieces in association with said board.

More specifically, the present game is directed to American politics and enables the players thereof to compete for the Presidency of The United States of America through involvement in a presidential political campaign and in so doing to increase their appreciation and knowledge of the importance and implications of the electoral college system and the vote apportionment connected therewith.

2. Description of the Prior Art:

Presidential election games have been disclosed in the prior art, for example, in U.S. Pat. Nos. 753,949; 2,043,482; 3,318,601; and 3,368,816. In contrast to the above, I have invented a novel game that utilizes gaming pieces that move to and from areas corresponding to states and the District of Columbia as one would through an election when the votes are being tallied. Furthermore, there has been provided in my game, posting means, which may be magnetic, for continuous updating and tabulation of the number of popular and/or electoral votes of each player. Also the total or partial number of votes obtained by each player in respect to U.S. Senators and/or U.S. Representatives in the U.S. Congress can be tabulated in the same, or similar, manner as the popular and or electoral college votes.

The advantages and distinctions of my invention over the prior art will become more clearly evident as the disclosure proceeds.

OBJECTS OF THE INVENTION

An object of the present invention is to provide a political game in which the winner becomes elected President.

Another object of the present invention is to provide apparatus to permit a number of players to participate in an election, with the excitement of winning the election State by State.

Other objects and advantages of the present invention will become apparent as the disclosure proceeds.

SUMMARY OF THE INVENTION

A presidential election game for one of the players to win and thus become "President" of the USA, which game comprises in combination a playing board of any suitable material, having its periphery divided into a series of outer zones or columns and a series of inner zones or columns intersecting the board, with the zones or columns being divided into a series of color playing squares, or boxes, corresponding to the fifty states plus other squares which may be designated as follows: one for the District of Columbia, one for the White House, one named "Convention Hall", and two assigned and named "Outlying U.S. Areas".

Each color playing zone or square has a color designation with a specific meaning that will hereinafter be discussed. Each color playing zone in the board game corresonding to a state and D.C. has numerical indicium being designative of the number of electoral college votes allocated to each one of them, also the name and capital city of the state, the number of inhabitants (1970 census) in each one, the ideal number of electors or voters elegible to vote in that particular state and District, obviously these census and ideal elector numbers will require periodic revision at least every 4 years.

All other playing zone areas have some pertinent information written on them. For example "Convention Hall" is the starting square of the game. Also the rearrangement of the squares in the zones or columns can be altered. A map of the United States is disposed centrally of the playing board, with the boundaries of each state and D.C. being outlined on the map. The names or abbreviations of the state or D.C. will appear in each corresponding space in the map. The states and D.C., and other areas if desired, will be divided into different groups by color designation, similar to the ones on the color playing zones on the playing board. These states on the map and D.C. are divided according to their population and for electoral college vote representation.

Each voting zone areas has indicium thereon which is a numbered guide as to the possible votes that may be needed by a player to win the state or D.C. according to the number of players of the game. The game is played by at least two players.

A map is disposed centrally of the playing board that has the boundaries of each state in the map outlined thereon. The states being identified by name. The states are divided into different groups by color designation according to their population and for electoral college votes representation. During playing of the game each player is to receive a marker that may take various forms well known in the art. During play of the game the marker is first placed on a starting zone and then moves from zone to zone of each state or other areas through pathways that are provided and which joins the color playing zones together.

Chance means operable by the players of the game are provided so as to produce a random number for determining the number of zones the player may advance. The chance means may be in the form of a pair of dice. Chance cards are provided and are picked by a player depending upon certain numbers obtained when the pair of dice are thrown. The states and D.C. in the central map and corresponding color squares zones may be grouped into seven different color groups with the number of states in each group varying from two up to sixteen states.

In the game board different colored pathways appear red and white being illustrated in the present embodiment, but can be altered as to number and color, between adjoining zones on the game board. There will be a varied number of the chance cards, each chance card having indicia thereon representative of an advantage one player may exercise over another player or a hazard that a player must suffer. In the present style of the game these chance cards are divided into two groups in which sixteen cards are in each group. Indicia and number of cards can vary.

The chance means operable by players of the game apparatus are provided so as to produce a random number for determining the number of color playing squares the player may advance, with posting means for indicating the number of popular and/or electoral college votes, number of U.S. Senators and Representatives posted by a player as the game progresses, and a marker for each player that differs in color and configuration. The markers are placed initially on the designated starting area, in the illustrated embodiment labelled "Conventional Hall", by each player and progressively moving from color playing zone to color playing zone on the pathways of the game board by utilization of the chance means and accumulating votes in order to win the election and become "President".

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
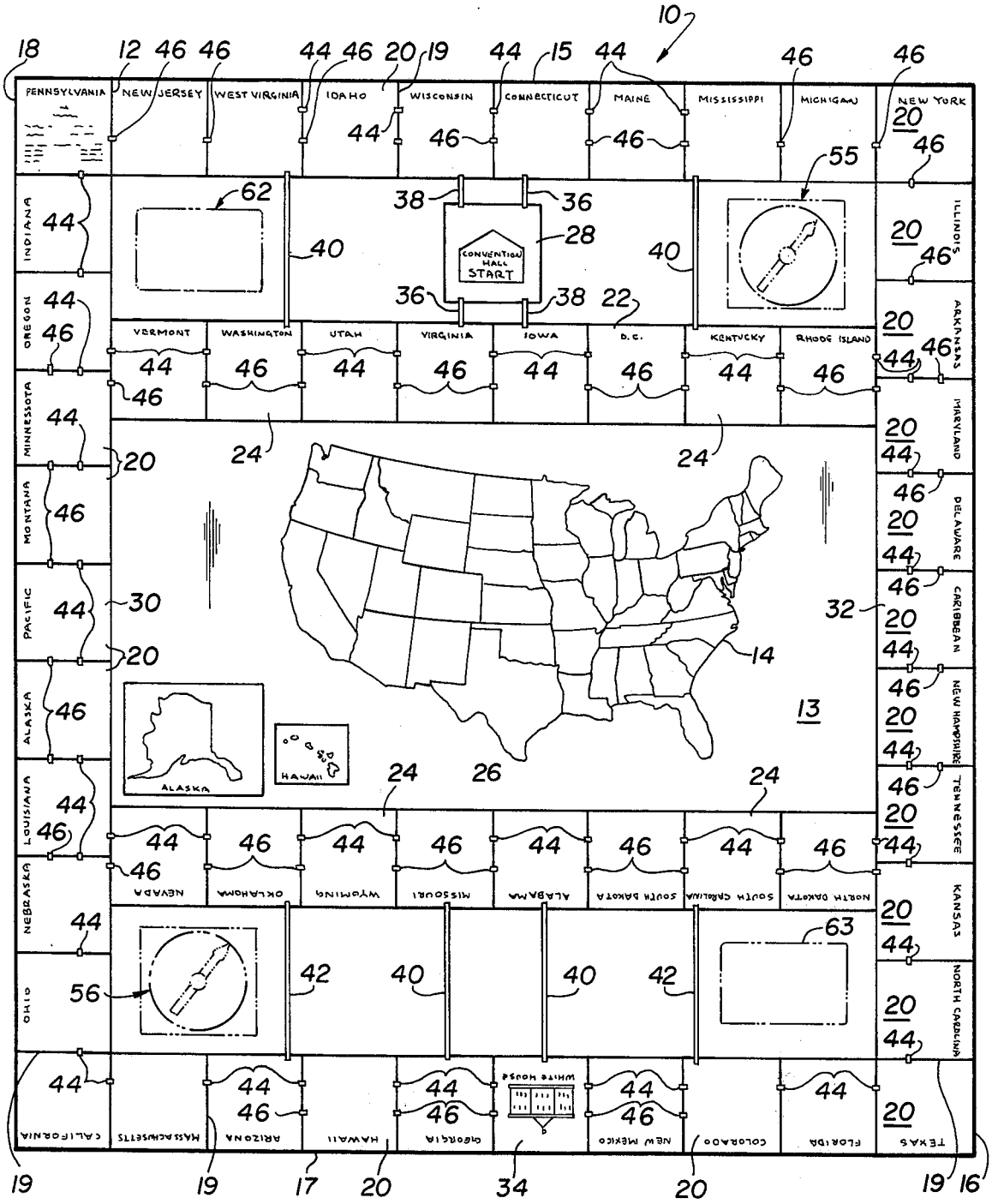
FIG. 1 is a plan view of the playing board in accordance with the present invention.

Referring to the drawings, FIGS. 1 through 12 illustrate the novel combination provided in the presidential election game 10 which includes a game board 12 made of any suitable material and being generally rectangular in configuration having a playing surface 13 thereon. The playing surface 13 is provided with a central map 14 of the United States that would include all of the fifty states, as well as the District of Columbia. The game board 12 has sides 15, 16, 17 and 18. Around the periphery of the game board 12 are a series of outer or peripheral columns 19 of outer squares or zones 20 extending along each of the sides 15, 16, 17 and 18 of the periphery of the game board 12. The outer zones 20 of progression are arranged about each side 15, 16, 17 and 18 of the periphery of the game board 12 to form a generally closed figure of four sides.

A first column 22 comprised of a series of inner zones 24 extends across the game board 12 and contiguous to a pair of columns 19 forming the outer zones 20 along spaced apart sides 16 and 18 of the game board 12. A second column 26 comprised of a series of inner zones 24 extends across the playing board 12 in spaced apart substantially parallel spaced relation to the first column 22 of the inner zones 24 and contiguous to a pair of outer columns 19 forming the outer zones 20 along spaced apart sides 16 and 18 of the game board 12.

A starting zone 28 on the game board 12, which is the starting position from which play of the game is commenced, is provided and positioned intermediate one of the columns 22 or 26 of the inner zones 24 and one of the columns 19 of the outer zones 20. As illustrated in FIG. 1, the starting zone 28 is situated between first column 22 and outer column 19. The starting zone 28 is entitled "Convention Hall Start".

The outer zones 20 may further include particular squares that are not one of the states or D.C. Outlying areas are identified by square 30 entitled "PACIFIC" and square 32 entitled "CARIBBEAN". In addition, square 34 is provided as one of the outer zones 20 and may be entitled "WHITE HOUSE". Accordingly, the outer zones 20 and inner zones 24 comprise at least fifty-one voting areas comprising the fifty states and the District of Columbia.

To permit movement from the starting zone 28, there is provided first lanes 36 and 38 connecting the starting zone with the outer zones 20 and inner zones 24 on opposite sides thereof. In this manner a path of travel is available from the starting zone 28. In addition, second lanes 40 and 42 are provided and extend between certain of the inner zones 24 and outer zones 20. To provide movement between adjoining zones 20 and 24, there is provided pathways 44 and 46.

Figure 2:
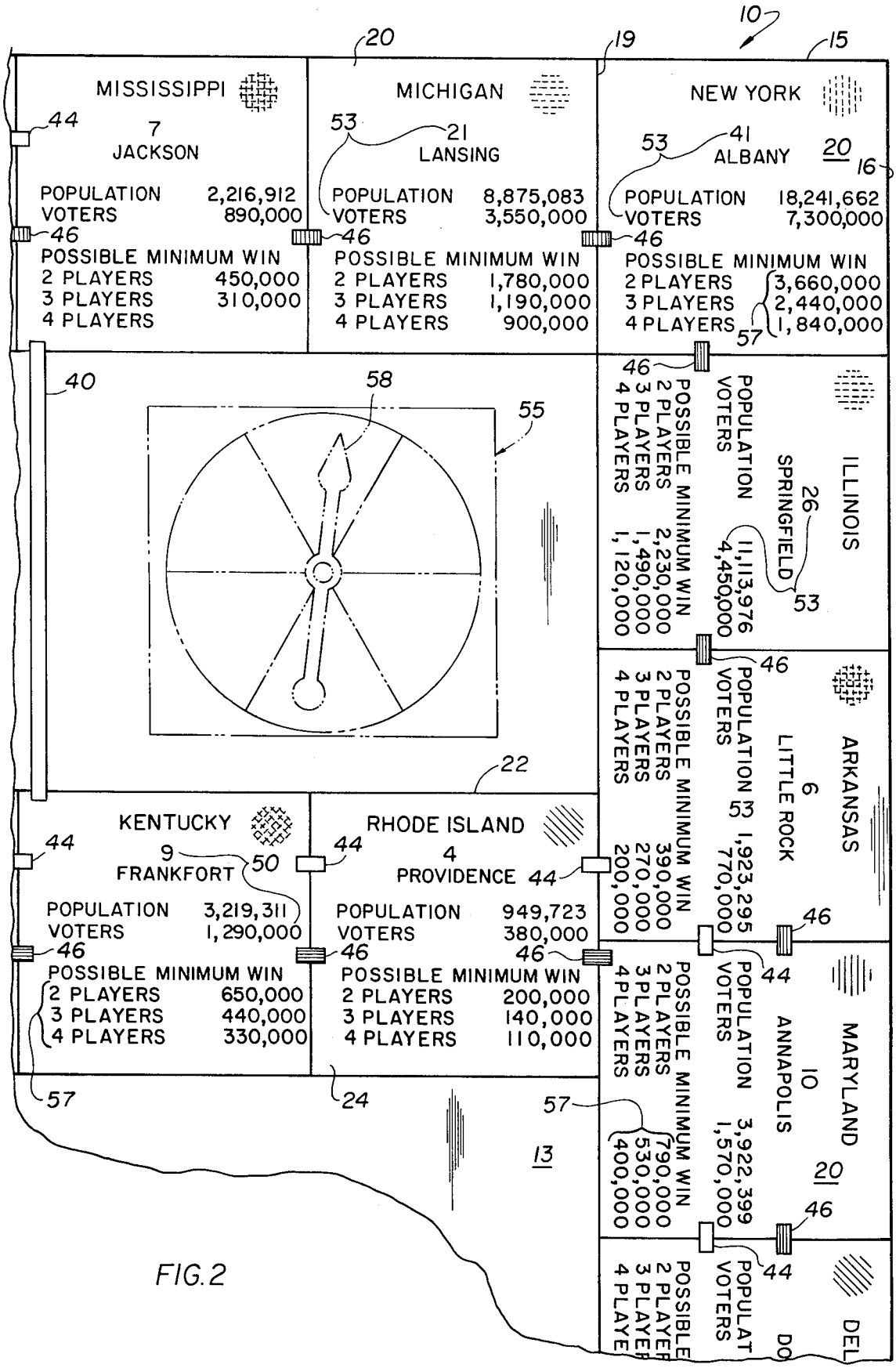
FIG. 2 is an enlarged fragmentary plan view of one corner of the board illustrated in FIG. 1, the lettering on the respective spaces or areas being clearly represented and the distinctive colors being indicated thereon according to the chart for draftsmen in the Patent Office Rules of Practice.
Figure 3:
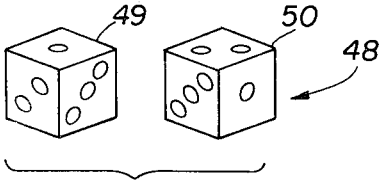
FIG. 3 shows a perspective view of a pair of dice which may be used as the chance means to determine the extent or length of the moves of the players along the path or course.

To control the path through which movement is obtained, there is provided chance means 48 that is operable by players of the game 10 so as to produce a random number for determining the number of zones that a player may advance. The chance means 48 may comprise a pair of dice identified as die 49 and die 50. Each die 49 and 50 is preferably differently coded. For example, die 49 may be equivalently coded in matching conformity with first lane 38, second lane 40, and pathway 44. As illustrated in FIG. 2, the color coding for these particular areas on the playing board may be white in color. In a similar fashion, die 50 may be red in color and the corresponding first lane 36, second lane 42 and pathway 46 may have corresponding color indicium.

Figure 11:
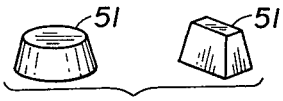
FIG. 11 is a perspective view of a playing piece utilized by the players during the game.

The purpose of setting apart die 49 and 50 from each other is that upon a roll of the dice 48, the die having the largest number appearing thereon is the particular path that the player must follow by movement of the markers or symbols identified by numeral 51 illustrated in FIG. 11. It is appreciated that each marker 51 for each player may differ in color or configuration. Each marker 51 is placed initially on the starting zone 28 by each player and progressively moving from zone to zone by utilization of the chance means 48 through the lanes and pathways.

Accordingly, if die 50 has the higher number thereon, the player must move his marker 51 through either lanes 36 or 42 as well as pathway 46. As illustrated in FIG. 2, the arrangement between zones 20 and 24 is such that certain pathways 46 are only situated between certain zones 20 such that it is more difficult to reach certain states.

The respective states and D.C. are divided into groups which are distinguishable from each other by the color selected. The color coding is illustrated on FIG. 2, and the fifty states and D.C. are divided into seven different color groups. The U.S. outlying areas 30 and 32, as well as the White House 34, may be included in these groups. Each of the state zones and D.C. includes first numerical indicium 53 contained on each of the zones 20 and 24. The first numerical indicium 53 being designative of the number of popular and/or electoral college votes allocated to each of the voting areas. The first numerical indicium 53 thereby indicates the number of voters in a state, as well as the number of electoral college votes allocated thereto, and may also include the population.

For example, as illustrated in FIG. 2, zone 20 representing New York has first numerical indicium 53 indicating 7,300,000 voters and 41 electoral college votes. This apprises each player in a simple manner of the value of winning a particular state. Second numerical indicium 57 is contained on each of the zones 20 and 24 and being designative of the possible number of minimum popular votes needed to respectively win a particular voting area. The second numerical indicium 57 for a possible minimum win is illustrated based upon a certain number of players of the game. For example, as illustrated for the state of New York in FIG. 2, if two players are playing the game, the possible minimum win is 3,660,000, for three players it is 2,440,000, and for four players it is 1,840,000.

The information contained below relates to the grouping of the voting areas and the preferable color identification of each group. It is appreciated that the color coding may be changed as well as the states in each group.

Group I. Green — Total 16 states (including D.C.) Population in these areas ranges from 300,000 people to 1 million people more or less, and Electoral College Vote (E.C.V.) ranges from 3 to 4.

1. Utah
2. New Mexico
3. Hawaii
4. Nevada
5. Wyoming
6. Idaho
7. Alaska
8. Montana
9. North Dakota
10. South Dakota
11. New Hampshire
12. Rhode Island
13. Delaware
14. D.C.
15. Vermont
16. Maine Group II. Yellow — Total 8 states. Population ranges from 1.5 million to 2.2 million people, and E.C.V. ranges from 5 to 8.

1. Arizona
2. Colorado
3. Oregon
4. Nebraska
5. West Virginia
6. Kansas
7. Arkansas
8. Mississippi Group III. Orange — Total 7 states. Population in these areas ranges from 2.6 million to 3.4 million more or less, and E.C.V. ranges from 8 to 9.

1. South Carolina
2. Kentucky
3. Alabama
4. Oklahoma
5. Washington
6. Iowa
7. Connecticut Group IV. Pink — Total 8 states. Population in these areas ranges from 3.6 million to 4.7 million more or less, and E.C.V. ranges from 10 to 12.

1. Georgia
2. Tennessee
3. Louisiana
4. Missouri
5. Minnesota
6. Wisconsin
7. Maryland
8. Virginia Group V. Red — Total 5 states. Population in these areas ranges from 5.2 million to 7.2 million people more or less, and E.C.V. ranges from 13 to 17.

1. Indiana
2. Massachusetts
3. New Jersey
4. North Carolina
5. Florida

Group VI. Blue — Total 5 states. Population in these areas ranges from 8.9 million to 11.7 million people more or less, and E.C.V. ranges from 21 to 27.

1. Illinois
2. Michigan
3. Ohio
4. Pennsylvania
5. Texas

Group VII. Purple — Total 2 states. Population in these areas ranges from 18 to 20 million people, and E.C.V. ranges from 41 to 45.

1. New York
2. California

In addition, the outlying U.S. areas identified by zones 30 and 32 have no electoral votes and may be color coded by a brown color.

By dividing the zones 20 and 24 into different groups as enumerated above, it is possible for each player in a simple manner by following the color of the zones to make a determination as to the value of a particular voting area that the player is attempting to win. Each player is permitted to move a respective marker 51 through the various pathways 44 and 46. It will be noted that pathways 44 may be considered a first group and pathways 46 a second group. The first group 44 connecting certain contiguous zones 20 and 24. The second group 46 connects other contiguous zones 20 and 24. Certain of the zones 20 and 24 are connected by pathways from each of the groups 44 and 46.

In this manner a degree of difficulty is provided in reaching certain voting areas. In a similar fashion the first lanes are similarly divided into the two distinguishable sets which are indicated by numerals 36 and 38. Similarly, the second set of lanes are also divided into the two distinguishable sets 40 and 42. As discussed above the chance means 48 is matched with respect to these lanes and pathways to control the route that the markers 51 may follow.

The above discussed game board 12 provides alternate courses for each marker 51 to follow and the player may select his or her own strategy as to which voting area one desires to win on the election road in becoming "President".

The map 14, which is disposed centrally of the playing board 12, has the boundaries of each state in the map 14 outlined thereon. The states being identified by name (not shown). The states are divided into different groups by color designation according to their population and for electoral college votes representation. The color selected for the different states on map 14 may correspond to the colors selected for the respective zones 20 and 24 identified above and divided into the seven groups.

Figure 4:
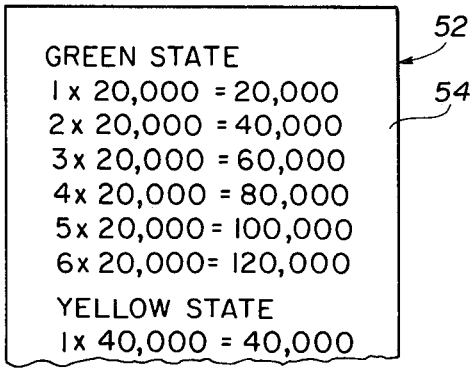
FIG. 4 is a plan view of one of a number of indicating cards having information contained thereon bearing different basic multiple numbers for each color group of states that can be used by the players to obtain the votes.
Figure 8:
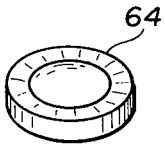
FIG. 8 shows a perspective view of a colored winning chip used in the game.
Figure 5:
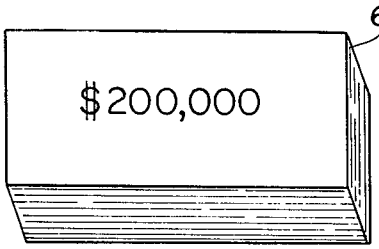
FIG. 5 is a perspective view of money available for use with the game.

To aid the player to calculate the number of votes that has been obtained on the player's usage of the chance means 48, there is provided indicating means 52 illustrated in FIG. 4. The indicating means 52 may be in the form of a card 54 that matches the color groups of the zones 20 and 24. The card 54 is identical to the color groups on the playing surface 13 with basic multiples of votes assigned to each group, such that these basic multiples are matched with the number the player obtains by the chance means 48 and as a result the player is given a total vote count obtained on usage of the chance means 48.

The indicating means 52 matches the color coding of the various groups and has "basic multiples" assigned to each group. For example, if die 49 is thrown and a five is the number thrown, and we are dealing with a "Green" state, then the player would receive 5 × 20,000 = 100,000 votes. In this manner the card 54 aids the players in playing the game. The speed at which the game is played is interrelated to the number of votes possibly obtained upon each throw of the dice 48. Therefore, the number of votes allotted or the basic multiple may be varied depending upon how fast one desires to play the game.

The marker 51 for each player differs in color or configuration, with the marker 51 placed initially on the starting square 28 by each player and progressively moving from zone to zone by utilization of the chance means 48 through the pathways 44 and 46, as well as first lanes 36 and 38; and second lanes 40 and 42; and accumulating popular votes and winning enough states with enough number of electoral votes in order to win the election and become "President".

Figure 9:
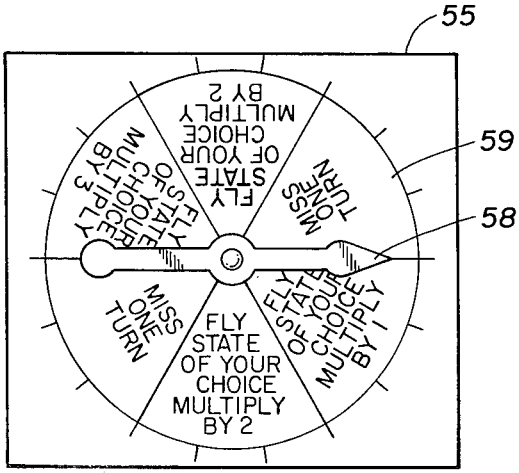
FIG. 9 shows a plan view of one form of assembly used in roulette game.
Figure 10:
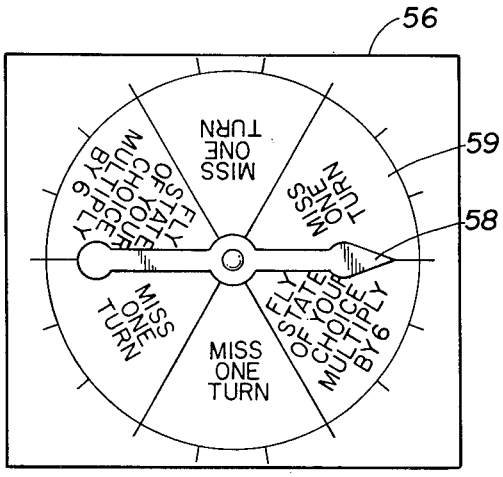
FIG. 10 shows a plan view of another form of roulette assembly used in the game.

Roulette means 55 and 56 are illustrated in FIGS. 9 and 10 respectively. The roulette means 55 and 56 may be positioned in diagonally opposite corners of the playing surface 13. As illustrated in FIGS. 9 and 10, the roulette means 55 and 56 contain a spinning element 58, and there is provided written indicia 59 which sets forth different information as to an advantage one player may exercise over another player or a hazard that a player must suffer. A source of money 60, illustrated in FIG. 5, may be distributed to each player for use during the game.

Figure 6:
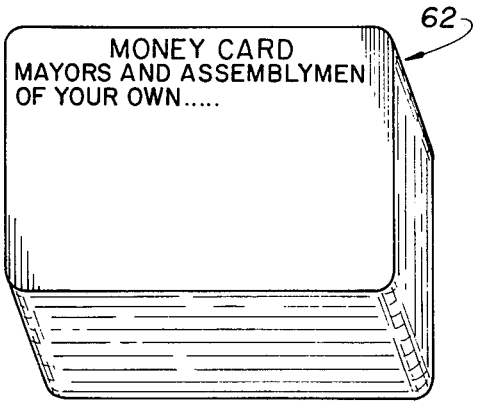
FIG. 6 is a perspective view of one set of chance cards which are supplied with the game.
Figure 7:
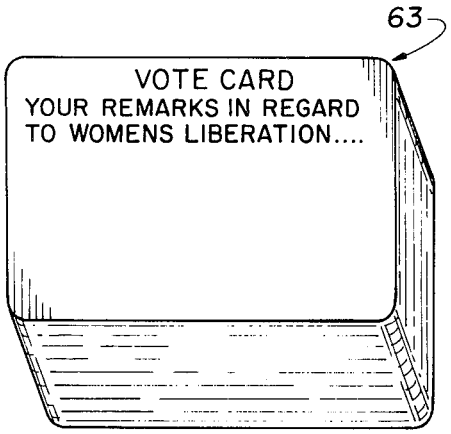
FIG. 7 is a perspective view of another set of chance cards which are supplied with the game.

To further make the game interesting, at least one set of chance cards is provided. As illustrated, a first set of chance cards 62 is illustrated in FIG. 6 and a second set of chance cards 63 is illustrated in FIG. 7. The respective sets 62 and 63 may be positioned in diagonally opposite corners of the playing surface 13, as illustrated in FIG. 1. The sets of chance cards 62 and 63 have indicia thereon representative of an advantage one player may exercise over another player or a hazard that a player must suffer.

As the game progresses, it is often desirous of quickly determining which player has won a particular state. Towards this end there is provided a plurality of distinguishable chips 64 distributed to each of the players at the start of the game for use in conjunction therewith. The set of chips 64 for each player may be appropriately identified by color, symbol, etc. In this manner when the player wins a particular state, his identifying chip may be placed thereon.

Figure 12:
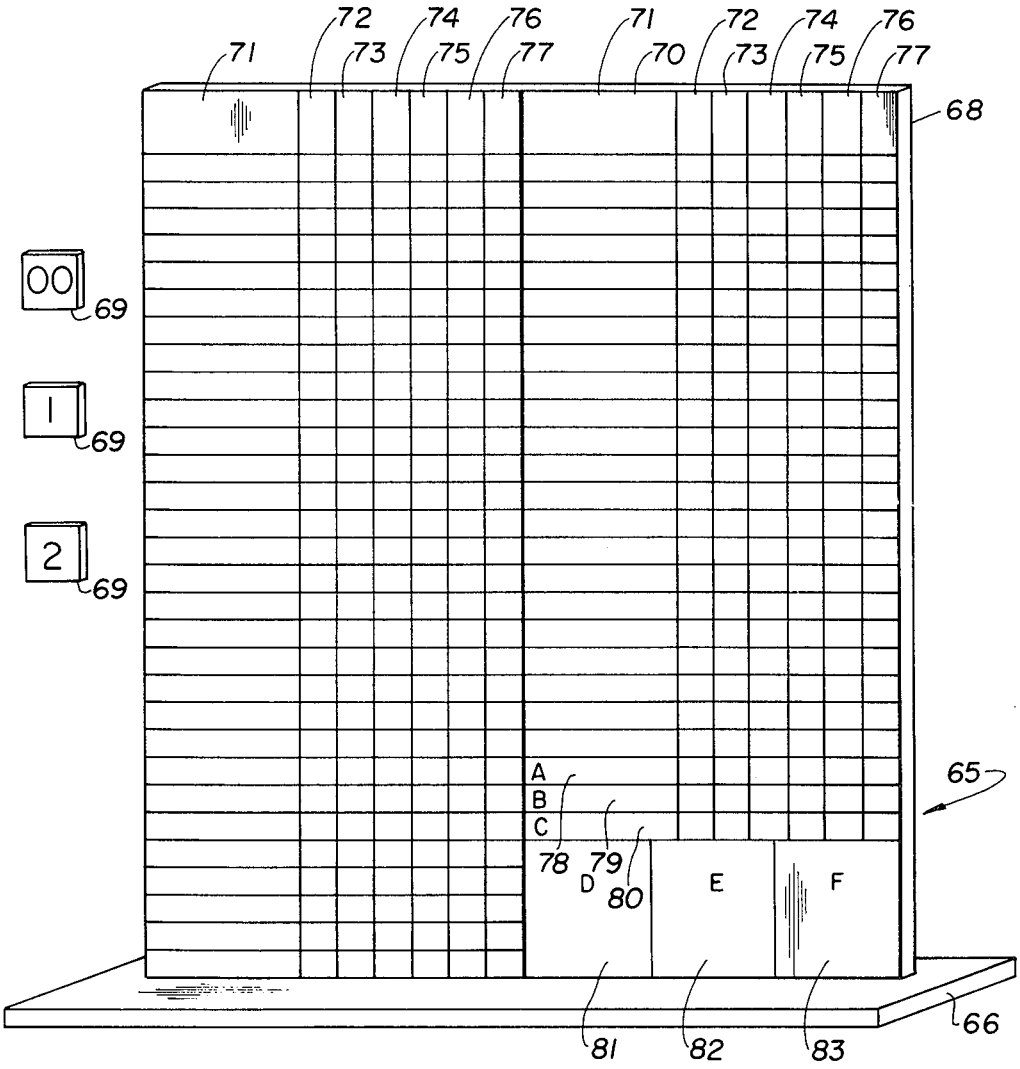
FIG. 12 is a perspective view of posting means for indicating the electoral or popular votes obtained by each player as the game progresses.

As the game progresses, it is important that a tally is maintained of the votes each player is accumulating in the fifty-one voting areas, and accordingly posting means 65, illustrated in FIG. 12, is provided. The posting means 65 may include a base 66 and a vertically extending wall 68. A plurality of individual pieces 69 are provided which have numerals thereon. The relationship between the pieces 69 and the wall 68 is that there is a magnetic attraction therebetween. This may be provided in a manner well known in the art.

The face 70 of the wall 68 has various information contained thereon and which may be provided in vertically extending columns. The first column 71 on the left hand side of the wall 68 may include the 51 voting areas listed alphabetically. Column 72 sets forth the electoral vote allotted to each voting area. Column 73 is the tabulation of the popular vote for the first player, which may be identified by the color blue. Column 74 is the tabulation of the popular vote for the second player, which may be identified by the color pink. Column 75 is the tabulation of the popular vote for the third player, which may be identified by the color white. Column 76 is the tabulation of the popular vote for the fourth player, which may be identified by the color yellow. These colors correspond to the players' markers 51.

Column 77 is provided for the tabulation of the electoral college vote. Due to the fact that there are fifty-one voting area, it will be noted that columns 71–77, inclusive, are separated into two sections on the wall 68. There is further provided on face 70 additional columns, column 78 utilized for the totals for the electoral college votes and identified as "A". Column 79 being utilized to list the totals for the election of U.S. Senators and identified as "B". Column 80 being utilized to list the totals for U.S. House of Representatives and indicated as "C".

There is also provided area 81 indicated at "D" which is utilized as a guide as to the possible number of electoral college votes needed to win according to the number of players. Space 82 identified as "E" is used as a guide as to the possible number of U.S. Senators required to win the U.S. Senate, according to the number of players involved. Space 83 identified at "F" is used as a guide as to the possible number of U.S. Representatives required to win or obtain a plurality, according to the number of players.

Accordingly, the posting means 65 is utilized for indicating the number of popular electoral votes plus number of U.S. Representatives and U.S. Senators posted by a player as the game progresses, and includes the magnetic vote tabulation means 68 for the individuals playing the game, and a plurality of magnetized pieces 69 having numerals thereon, with the pieces 69 adapted to be placed on the vote tabulation means 68.

In playing the game each player rolls the pair of dice 48 when their turn comes up and advances to the color playing zone the player wishes or can reach depending upon the number of the die 49 and 50. Upon landing on zones 20 and 24 representing any of the 51 voting areas, the two U.S. outlying areas 30 and 32, White House 34, and conventional hall 28, the player calculates the number of votes obtained on that throw, if any, by looking to the indicating means 52 which each player is provided with. In this simple manner the player can determine how many popular votes were obtained on that throw for a particular voting area.

The basis multiples set forth on each indicating card 54 is matched with the highest number the player can roll on a particular throw of the dice 48, keeping in mind that the numbers of only one die are utilized. On the tabulation or posting means 65 the number of popular electoral votes gained by each player on each throw is posted. It is appreciated that the popular vote concept may be followed, rather than the electoral vote as is used today. In which case the player winning the largest number of popular votes will become "President". Furthermore, posting means 65 may be on a flat board-like surface that is provided to serve the same end purpose previously discussed.

The indicating means 52 may or may not match the color groups of the tokens or markers 51 each player has. The basic multiples are matched with the highest number the player rolls with the dice 48, and as a result the player is given the total vote count obtained in that throw of the dice 48 using one die 49 or 50. On the tabulation or posting means 65 the number of popular U.S. votes gained by each player on each state is posted. This will vary as the game progresses for each player. The supply of magnetized pieces 69 are magnetically posted as the popular, electoral votes per U.S. Representatives and/or U.S. Senators per player changes. The posting of U.S. Senators on the tabulating board will be on area 79. The posting of U.S. Representatives on the tabulating board will be on area 80.

Players roll the dice 48 and advance with certain privileges whenever they roll a double, for example, they can advance along either colored pathway 44 or 46; or lanes 36, 38, 40 and 42; or can draw a chance card 62 and 63. Also in its preferred embodiment whenever certain numbers are rolled, like seven and eleven, they are entitled to turn the roulette means 55 and 56. Some chance cards 62 or 63 have advantages, others have disadvantages to the player and/or his opponents. They deal with transference of votes, loss or gaining extra votes, also missing or taking throws. They also deal with money matters (e.g. money 60 obtained through special ways for votes, etc.).

The money 60 is distributed to each player at the start of the game. As the game progresses players keep adding votes to the states they reach, and upon winning some states the number of electoral votes are added and posted on their respective areas using the posting means 65. Each player has to have votes in a minimum number of states, preferably thirty, in order to qualify to become President. The votes needed to win in each state have been determined by a percentage of the ideal number of voters in each state and based on census population and general U.S.A voting trends in past elections. Each player is represented by his or her own marker 51, each one in a different color, and winning chips 64, which are to be placed in the state each player wins, are given to each player.

Starting point in this game is the Convention Hall square 28. The states in the map 14 are represented in the zones 20 and 24 around and intersecting the game board in the form of colored playing squares, and these colored playing squares have information in regards to the number of electoral votes alloted to each state or D.C. The name of the state and the name of the capital city of each state may be provided in each voting zone, as illustrated in FIG. 2. The number of voters illustrated herein is by population according to census 1970, and both the ideal number of voters and population according to census will require periodic revisions. Information in regard to possible number of minimum popular votes required to win in each state or D.C. when playing with different numbers of players is contained in each voting zone at the second numerical indicium 57.

In addition, the game has provision for simultaneously selecting Senators and Representatives to the U.S. Congress. The player will win the two U.S. Senators, upon winning a state, and the members of the U.S. House of Representatives will be assigned on a percentage basis and will be posted in respective zones on the posting means 65. A guide as to the possible number of U.S. Senators required to win the U.S. Senate, according to the number of players involved, may appear on the posting means 65. Also a similar area with the same purpose to act as a guide may appear on the posting means 65 in regards to U.S. Representatives.

RULES OF PLAY

The rules of play may be contained in special instructions to provide the players with the necessary guidance in playing the game. Additional aspects of the game are identified in conjunction with the rules of play.

Set forth below are various instructions and aspects to the present invention which are interrelated with the structure described above in order to obtain the game 10 with its various aspects to it.

I. OBJECT: The aim of the game is to become President of the U.S.A. by winning a majority (or plurality if such is the case) of the electoral votes of all the players. The number of electoral votes needed to win depends on the number of players. To accomplish this, a player has to win a certain number of states (by a majority or plurality of the popular votes in each state) whose electoral college vote total will enable the player to obtain that majority or plurality. Also, the players will be able to elect senators and representatives to the U.S. Congress. However, the tally of this is not mandatory except:

(A) If necessary to resolve a tie (state or presidency) between two or more players. (See Sections: V-N, V-O, V-P)

(B) If the players agree at the beginning of the game to tally them.

(C) A President-elect is in debt for one million dollars or more (See Sections V-M, V-K-l).

(D) The President-elect does not have electors in at least thirty states (See Section V-M).

II. PLAYERS: In the present format of the game, from two to a maximum of four single players can play the game. (The maximum number of single players can be subject to be increased provided other criteria of the game are altered.)

III. IMPLEMENTS:

(A) One large multi-colored board 12 of any suitable material marked appropriately for the game, as illustrated in FIGS. 1 and 2.

(B) Four different colored markers or tokens 51. In the present embodiment of the game they are white, blue, red and yellow.

(C) Play money — In the present arrangement of the game the money 60 is of different denominations in the following quantities and colors:

| | Quantity | Denomination | Color |
|---|---|---|---|
| | 20 | $500,000 | gold |
| | 30 | $200,00 | green |
| | 50 | $100,000 | blue |
| | 90 | $50,000 | pink |
| Total | 190 | | |

(D) Four sets of different colored winning chips 64 ("WC") are provided. These may correspond to the different colored tokens or markers of each player. In the present style of the game 30 WC are given to each player. (The amount given can vary.) But let's state that only one set of 51 WC in a neutral color (for example, gold) can be used for all the players. These WC are placed in the state or D.C. voting areas to show that that state has been won.

(E) An amount (quantity will vary) of magnetized pieces 69 having numbers on them that are utilized by placing them on the tabulation board 68 to keep the score of electoral college/popular votes, Senators and Representatives tallies. The numbers that appear on the magnetized pieces, in the present arrangement of the game, go from 0 to 9 and then 00, 20, 40, 50, 60, 80, and 000, but these numbers can be modified. The background on which the number is written and/or the number itself, can have the same color (as in the present format of the game) as the tokens used by each player. This can be changed, and all the numbers and/or the background on which they are written may have one neutral color (for example, black).

(F) Two roulettes 55 and 56 with different options of chance, as illustrated in FIGS. 9 and 10, are provided.

(G) Two stacks or sets 62 and 63 of marked playing or chance cards with written information on them, representative of an advantage one player may exercise or a hazard or penalty he must suffer. The indicia on these cards are subject to variation. In the present game form these two stacks are named:

(1) Vote Cards — 16 of each (2) Money Cards — 16 of each The number of chance cards 62 and 63 and indicia thereon can vary.

(H) One or four "rapid vote calculation card(s)" (RVCC) or indicating means 52 may be utilized. In the present form of the game the card is in a neutral color or in white. If there is only one it is to be shared by all the players. Or if preferred, a different card with the same information can be given to each player, but each card if desired may have the color background corresponding to the color of the token 51 each player has.

(I) Posting means or tabulation board — The number of popular votes, electoral college votes, U.S. Senators and Representatives gained by each player are posted here. This will vary as the game progresses for each player. The tabulation means 65 in the present arrangement consists of a face 70 with the name of the state and D.C. on one side and to the right of it four different colored columns or zones 73, 74, 75 and 76 allotted for posting each player's score. Each column will have a different color background corresponding to the player's token color. Also, space will be provided for the totals of electoral college votes, total number of Senators and Representatives. In its present form, as we are using rounded figures in each area for posting popular votes, the three final zeros will appear as follows—i.e.—,000.

(J) A pair 48 of different colored dice 49 and 50 is to be shared by all the players. In the present form there is one white background die with black dots on each surface and one red background die with white dots on each surface. The dots vary like on any other ordinary die; with six sides and dots ranging accordingly from one to six. The color and number of dice 48 can be subject to change. Also, if desired, each player may be provided with a pair of dice 48.

IV BEGINNING OR PREPARATION (STARTING) OF THE GAME:

(A) Place the game board 12 on a table or suitable playing surface. Position the two sets of playing cards 62 and 63 face down in their assigned spaces and the two roulettes 55 and 56 in their assigned spaces.

(B) Select a player or nonplayer (observer) to be the Federal Election Commissioner. His duties consist of: posting the tallies on the tabulating means 65 and acting as a banker, (i.e. collecting penalties, distributing the money, etc.). If the players so agree, these duties can be shared or divided by one or more players or a nonplayer.

(C) Each player chooses a colored marker 51 to represent him in the game. This is done by accorded selection or by chance, for example, rolling the highest number with one die.

(D) Each player is given play money 60 to a total amount of four million dollars to each one. According to the present game format, but this can vary, each player receives:

Two $500,000 bills totaling $1,000,000.00 (Gold)

Five $200,000 bills totaling $1,000,000.00 Green)

Ten $100,000 bills totaling $1,000,000.00 (Blue)

Twenty $50,000 bills totaling $1,000,000.00 (Pink) All the remaining money is to be given to the Federal Election Commissioner.

(E) A pair of different colored dice 48 is to be shared by all players or as stated in Section III-J each player can have his or her own pair.

(F) The Federal Election Commissioner will be in charge of the magnetized vote markers 69, and he will keep score. But if as stated in Section III-E, the magnetized vote markers 69 are of different colors (same as tokens), then these markers will be distributed among the corresponding players and they will keep their own score.

(G) The different colored WC are distributed to each player for their accorded use. If only one set of neutral colored WC (see section III-D) are used, then the Federal Election Commissioner will be responsible for their control. If when playing the game with different colored WC (see Section III-D) and a player has won more states than he has of individual colored WC, he may borrow some unassigned colored WC.

(H) Players are given a rapid vote calculation card or indicating means 52 (see Section III-H).

V. PLAYING THE GAME:

(A) Each player places his marker 51 in area 28 denoted as "Conventional Hall". Name or starting place can vary.

(B) Each player in accorded turn rolls one die 49 or 50, and the player with the highest number goes first, then the others follow in turn in a counter-clockwise manner. In case of a tie for the first position spot, the players involved throw the die again until the tie is resolved. The higher one is first, and he or she starts.

The one that comes in second in the tie breaker has the option to be second, but he has to situate himself next to the person who goes first in a counterclockwise position. If he declines this, then he plays in his natural seating order.

(C) When the player rolls the dice 48, he follows the color lanes and pathways between adjacent areas, state to state, to Convention Hall, to Outlying U.S. Areas, to the White House, of the same color as the background of the die 49 or 50 with the higher number which is rolled. The smaller number does not count as far as advancing the marker 51 is concerned.

(D) When the player completes his moves along the lanes 36, 38, 40 or 42, or pathways 44 and 46, he will land in a zone 20 or 24 of a certain color, as described in the seven Groups defined above. He can go through or land in any of these zones if he so needs, desires, wishes, or is permitted by the rules of the game. Two or more players may share a given zone at one time.

(E) A player can go straight forward or backward in any direction he so desires or is allowed to in each turn, but a player may not go back and forth (backtrack) between pathways connecting two adjacent color playing zones in one turn.

(F) After a player completes his move and arrives on a color playing zone, he then examines the rapid vote calculation indicating means 52 and looks for the color grouping of the voting zone in which he landed. Following that he locates the column that corresponds to the number on the upper face of the highest colored die (see also Section V-H). There he will see the corresponding die number multiplied by the "basic multiple number" assigned to that colored playing zone. The result that appears on the far right side of the card is equivalent to the number of popular votes player obtained in that throw in that zone.

(G) Now the Federal Election Commissioner or individual player (see Sections IV-B and IV-F) will take out the vote markers (magnetized pieces) corresponding to the number of votes the player won in that throw in that state or district. These vote markers will be placed on his colored column in the row following that state or district on the tabulation board (see Section III-I). There it will show on the tabulation board how many popular votes he has attained in that state or D.C. Every time he gets to a state or D.C. the player keeps adding votes accordingly in the same manner. Whenever he is subjected to penalties he may have to subtract some votes from the tabulation board. He will follow a similar procedure for posting the number of electoral college votes U.S. Senators and U.S. Representatives on the tabulation board (see Section III-I).

(H) When a player rolls a double, he has the privilege of moving along either colored pathway 44 or 46 or lanes 36, 38, 40 and 42. For example, if he rolls two 5's, he may move five spaces following the red pathway 46 of five spaces following the white pathway 44. After completing his move (arriving in the corresponding colored zone and posting his popular votes), he must pick the top card from one of the two stacks of cards 62 and 63, as illustrated (they are known as "Money Card" and "Vote Card", respectively). He must follow its instructions and place the card face down at the bottom of the same stack.

(I) When a player rolls a combination of seven, one and six, two and five, three and four or eleven, five and six, he gets a chance to spin either one of the two roulettes 55 and 56. Before he spins the roulette of his choice, he must complete his regular moves (land in the color playing square and post his votes). Then he may spin the roulette and carry out its instructions.

(J) The player wins a state or D.C. when he has obtained the majority or plurality of votes required in each state or D.C. according to the number of persons playing the game (see Section I —"Object"). In each assigned colored playing zone for every state and D.C. on the game board, there is a guide as to the possible minimum number of popular votes required to win when playing with a different number of players (from two to four). The players should understand that a "possible minimum of votes needed to win" does not necessarily mean that the player is going to win with that number of votes. The exception is only if he attains the possible minimum of votes for two players regardless of the number of players involved. Try to study carefully and understand this "possible minimum win" matter as it can lead to misunderstandings and confusion among the players.

(K) Upon winning a state or D.C., the Federal Election Commissioner or the player who wins it places a winning chip WC in the state or D.C. zone (see Sections III-D, IV-B, and IV-G). For all purposes that state or D.C. is excluded from all plays and transactions except for the ones below:

1. A player who lands in a state already won by an opponent has to add his votes to the tally whether he has already any votes there or not. This is done in order to assure that the players may get votes in a minimum of 30 states and D.C. Make sure that upon adding the voltes the rules in Section V-L are applied.

2. A player who throws a seven (7) or eleven (11) and spins the roulette or throws a double and picks a card (see Sections V-H and V-I) may find that after his regular move (landed in a colored playing zone and gained enough votes to win) he may not be able to win that state or D.C. if the instructions on the card or roulette mandate that he lose enough votes to refrain him from winning in that same play.

(L) At no time shall the number of the popular votes (sum of the total of popular votes) obtained by all of the different players in a state or D.C. exceed the total number of voters (electors) for that particular state or D.C. as printed in their colored playing zone on the game board. When the total number of votes obtained by all the players in a certain state or D.C. equals the total number of electros for that state or D.C., then that state or D.C. is called "closed" for all rules without any exception. Note that a state or D.C. can be won without the state or D.C. being "closed".

(M) According to the game in its present form, in order to become President, a player must have popular votes in a minimum of 30 states and/or D.C. This can be altered by a change in the rules or it can be decided otherwise by a majority or plurality of the players before the beginning of the game. If the minimum is not attained by the player with the majority or plurality of electoral votes at the end of the game, then the President-elect will be determined by the House of Representatives (see Section V-P). Also if such a player should be in debt for a million dollars ($1,000,000.00) or more, the selection of the President will also fall on the House of Representatives. This can be modified, either by disregarding this debt clause or changing the amount of indebtedness. This can be done either by a change in the rules or by accord between the players before starting the game.

(N) In a case of two or more players being tied in popular votes in any given state or D.C., the winner and subsequent order (second, third or last), will be determined by the House of Representatives at the end of the game (see Section V-P).

(O) Election of Senators and Representatives to the U.S. Congress:

1. Senators — Every time a player wins a state, he automatically obtains the two U.S. Senators assigned to that state and can post them immediately in the corresponding score space reserved for the U.S. Senate on the tabulation means 65. In case of a tie, see Section V-N.

2. Representatives (a) When a player wins a state, he obtains the number of U.S. Representatives for that state as shown on the "U.S. House of Representatives (Congressmen) Apportionment Chart" (hereinafter referred to as "The Representative Chart").

(b) The players that finish second and/or third in that state or D.C. will get the number of Representatives shown in the "Representatives Chart". If four people play the game, at no time will the player who finishes fourth get any Representatives at all.

(c) In case there is no second place player and/or third place player in a given state or D.C. by the time a player has been elected President, then the number of Representatives that would have been allotted to those players is then given to the first place player.

(d) No player will post his tally of U.S. Representatives for a given state or D.C. in the corresponding space in the tubulation board until one of these or more of these conditions have been met: (1) The game has ended (a President has been elected). (2) All the first three finishing positions in the state or D.C. have been accounted for. (3) In case a tie-breaking decision is required (see Section V-P and Section V-O Senators). (4) Until the state is called "closed" (see Section I — Object).

(P) In case of:

1. A tie for the Presidency between two or more players,

2. A President-elect is in debt for one million dollars or more (see Section V-M), 3. The President-elect does not have electors in at least 30 states or as stated otherwise (see Sections V-K-1 and V-M).

If the conditions in 1, 2, and 3 should occur, a majority (a plurality if such is the case) of U.S. Representatives will select the President of the U.S.A. In order for the U.S. House of Representatives to hold a vote on these matters, this can be accomplished if one of the following criteria are met. All the states are "won" or "closed" at that particular time. But if that has not been accomplished then the game should proceed until that is done.

(Q) If all other states are "won" or "closed" and there are ties in one or more states in respect to the number of Representatives (and their vote is necessary to determine a tie), the selection of Representatives in dispute will be determined by the vote of the Representatives that have been already selected.

(R) Outlying U.S. Areas — When landing in any one of these two colored playing zones 30 or 32, you do not have any opportunities to gain any electoral college votes there since these areas do not have any electoral college vote representation. The great majority of the inhabitants of these areas are U.S. citizens, a major number of them do not have the privilege of voting for the President of the U.S.A., nor can they elect Representatives with votes in the U.S. Congress. Because of that your stop in any one of these areas is considered as a vacation and/or strategy meeting stay with important aides of your campaign, and therefore you will pay $100,000 for the expenses incurred every time you land in any one of them.

(S) Every time you win a state or D.C. you will have to pay for the expenses your campaign required in each one, and they are assigned as follows (they can vary):

Green state — pay $100,000.00
Yellow state — pay $200,000.00
Orange state — pay $300,000.00
Pink state — pay $400,000.00
Red state — pay $500,000.00
Blue state — pay $600,000.00
Purple state — pay $1,000,000.00

(T) White House Area — Every time you land here designated by 34, you are in for a briefing on national and international affairs by cabinet members and important presidential aides. Your stay in this area will oblige you to miss one turn, but you will be given two hundred thousand dollars ($200,000.00) every time you land here for the expenses and losses incurred.

(U) Money Matters — Any money that you collect due to game rules or card instructions, or any money that you have to disburse due to similar reasons, must be given to the Federal Election Commissioner (or designated banker) if it is not specified to whom it goes or from whom it comes (see Section IV-B). If the Federal Election Commissioner (or designated banker) at any time should be without money ("broke"), he simply must issue as much money as he needs by writing on ordinary paper the required amount of money needed.

(V) Cards:

1. If you should pick any card in reference to vote penalties and transfers, you must follow the directions. If, however, you should be in a state or D.C. where you have no votes or less than the total sum of votes required to carry out the transaction, you may not:

(a) give or transfer partial amounts, (b) take votes from any of the same or different colored states or D.C. (yours or any other player) to make up for the total, (c) postpone or delay giving or transferring the votes for a future play, (d) you cannot borrow votes from any states or D.C. either from yourself or any other player, (e) you cannot give I.O.U.'s to the Federal Election Commissioner (see Section IV-B), (f) note that transfer does not mean exchange.

2. In regards to money matters (penalties), the same laws prevail as to the vote cards, i.e. If you are to pay some money at a particular time and you do not have any or the exact sum, your penalty or debt is considered cancelled and if you come into any sum of money later on you are not obliged to pay the past debt or money penalties.

The rules of the game may also contain a chart indicating the number assigned to each voting area as to the election of members to the House of Representatives. In this manner it can be determined how many members for each election are to be won by the winner of the game, second place winner, and third place winner. It is appreciated that the rules of the game may be varied considerably with the same end result being obtained.

Although an illustrative embodiment of the invention has been described in detail herein with reference to the accompanying drawings, it is to be understood that the invention is not limited to the precise embodiment and that various changes and modifications may be effected therein without departing from the scope of spirit of the invention.

I claim:

1. A presidential election game for one of the players to win and thus become "President", said game comprises in combination:

A. a game board having a playing surface,

B. a series of outer zones extending along each side of the periphery of said game board, C. a first series of inner zone extending across said playing board and contiguous to said outer zones along spaced apart sides of said game board, D. a second series of inner zones extending across said playing board in spaced apart relation to said first series of inner zones and contiguous to said outer zones along spaced apart sides of said game board, E. said outer and inner zones comprising at least 51 voting areas comprised of the 50 States and the District of Columbia, F. first numerical indicium contained on each of said zones, said first numerical indicium being designative of the number of popular and/or electoral college votes allocated to each of said areas, G. second numerical indicium contained on each of said zones, said second numerical indicium being designative of the possible minimum number of popular votes needed to respectively win each of said areas, based upon a certain number of players of the game, H. said zones being divided into different groups by color designation according to their population and/or electoral college votes representation, I. pathways between adjoining zones on said game board, J. a set of chance cards, each said chance card having indicia thereon representative of an advantage one player may exercise over another player or a hazard that a player must suffer, K. chance means operable by players of the game apparatus so as to produce a random number for determining the number of zones the player may advance, L. posting means for indicating the number of popular and/or Electoral College votes posted by a player as the game progresses, and M. a marker for each player that differs in color or configuration, said marker placed initially on one said zone by each said player and progressively moving from zone to zone by utilization of said chance means through said pathways and accumulating votes in order to win the election and become "President".

2. A presidential election game as in claim 1, wherein said posting means includes:

a. magnetic vote tabulation means for the individuals playing the game, and b. a plurality of pieces having numerals thereon, said pieces adapted to be placed on said vote tabulation means.

3. A presidential election game as in claim 2, wherein said vote tabulation means includes a base and a vertically extending wall.

4. A presidential election game as in claim 1, said pathways being divided into a first group and a second group, said first group connecting certain contiguous zones, said second group connecting certain contiguous zones, and certain of said zones being connected by pathways of each of said groups.

5. A presidential election game as in claim 4, a. wherein said chance means comprises a pair of dice, and b. wherein said chance cards are picked by a player depending upon certain numbers obtained by said pair of dice.

6. A presidential election game as in claim 5, wherein said dice are coded, such that one die corresponds to said pathways of said first group, and said other die corresponds to said pathways of said second group, such that movement of said marker by each player through said pathways is dependent on said pair of dice.

7. A presidential election game as in claim 1, a. said zones are divided into seven different color designated groups, and b. said number of zones in each said group varying from two up to sixteen.

8. A presidential election game as in claim 7, and indicating means available to each player that calculates the number of votes the player has obtained on the player's usage of said chance means.

9. A presidential election game as in claim 8, said indicating means being in the form of a card that matches the color groups of said zones, said card being identical as the color groups on said playing board with basic multiples of votes assigned to each group, such that these basic multiples are matched with the number the player obtains by said chance means and as a result the player is given a total vote count obtained on each usage of said chance means.

10. A presidential election game as in claim 1, and roulette means operatively associated with said playing board and utilized by a player depending upon certain numbers obtained by said chance means.

11. A presidential election game as in claim 1, and money distributed to each of the players at the start of the game for use in conjunction therewith.

12. A presidential election game as in claim 1, and distinguishable chips distributed to each of the players at the start of the game for use in conjunction therewith, said chips being placed upon a voting area that has been won by a player.

13. A presidential election game as in claim 12, wherein said set of chance cards are positionable on said game board between one of said inner zones and a row of said outer zones adjacent one said side of said game board.

14. A presidential election game as in claim 1, and one of said zones on said game board being the starting position from which play of the game is commenced.

15. A presidential election game as in claim 14, wherein a. said game board is generally square in configuration, said outer zones of progression are arranged about each side of the periphery of said game board to form a generally square closed figure of four sides, b. said inner zones extending in substantially parallel spaced relationship to each other, c. said inner zones terminate contiguous to said outer zones at each end thereof, and d. said starting zone is positioned intermediate one of said inner zones and said outer zones extending along one said side of said game board.

16. A presidential election game as in claim 15, including first lanes connecting said starting zone with said inner zones and said outer zones that extend on opposite sides thereof, such that a path of travel is available to each said marker from the starting zone.

17. A presidential election game as in claim 16, wherein said first lanes are divided into two distinguishable sets which are related to said chance means which determines which of said two distinguishable sets of lanes each said marker can follow from said starting zone.

18. A presidential election game as in claim 17, including second lanes extending between each of said inner zones and said outer zones.

19. A presidential election game as in claim 16, wherein said second set of lanes are divided into two distinguishable sets which are related to said chance means which determines which of said two distinguishable sets of lanes each said marker can follow between connecting ones of said zones.

20. A presidential election game for one of the players to win and thus become "President", said game comprises in combination:

A. a game board being generally rectangular in configuration having a playing surface thereon, B. a series of columns of outer zones extending along each side of the periphery of said game board, C. said outer zones of progression are arranged about each side of the periphery of said game board to form a generally closed figure of four sides, D. A first column comprised of a series of inner zones extending across said game board and contiguous to a pair of columns forming said outer zones along spaced apart sides of said game board, E. a second column comprised of a series of inner zones extending across said playing board in spaced apart substantially parallel spaced relation to said first column of said inner zones and contiguous to a pair of columns forming said outer zones along spaced apart sides of said game board, F. a starting zone on said game board which is the starting position from which play of the game is commenced, said starting zone is positioned intermediate one of said columns of said inner zones and one of said columns of said outer zones, G. said outer and inner zones comprising at least 51 voting areas comprised of the 50 States and the District of Columbia, H. first numerical indicium contained on each of said zones, said first numerical indicium being designative of the number of popular and/or electoral college votes allocated to each of said areas, I. second numerical indicium contained on each of said zones, said second numerical indicium being designative of the possible minimum number of popular votes needed to respectively win each of said areas, based upon a certain number of players of the game, J. said zones being divided into different groups by color designation according to their population and/or electoral college votes representation, K. pathways between adjoining zones on said game board, L. first lanes connecting said starting zone with said inner zones and said outer zones that extend on opposite sides thereof, such that a path of travel is available from the starting zone, M. second lanes extending between certain of said inner zones and said outer zones, N. a set of chance cards, each said chance card having indicia thereon respresentative of an advantage one player may exercise over another player or a hazard that a player must suffer, O. chance means operable by players of the game so as to produce a random number for determining the number of zones the player may advance, P. posting means for indicating the number of popular and/or electoral college votes posted by a player as the game progresses, and Q. a marker for each player that differs in color or configuration, said marker placed initially on one said starting zone by each said player and progressively moving from zone to zone by utilization of said chance means through said lanes, and pathways so as to accumulate votes in order to win the election and become "President".

21. A presidential election game as in claim 20, wherein said first lanes are divided into two distinguishable sets which are related to said chance means which determines which of said two distinguishable sets of said first lanes each of said marker can follow from said starting zone.

22. A presidential election game as in claim 20, wherein said second set of lanes are divided into two distinguishable sets which are related to said chance means which determines which of said two distinguishable sets of said second set lanes each said marker can follow between connecting ones of said zones.

23. A presidential election game as in claim 20, wherein said posting means includes:

a. magnetic vote tabulation means for the individuals playing the game, and b. a plurality of pieces having numerals thereon, said pieces adapted to be placed on said vote tabulation means.

24. A presidential election game as in claim 23, wherein said vote tabulation means includes a base and vertically extending wall.

25. A presidential election game as in claim 20, said pathways being divided into a first group and a second group, said first group connecting certain contiguous zones, said second group connecting certain contiguous zones, and certain of said zones being connected by pathways of each of said groups.

26. A presidential election game as in claim 25, a. wherein said chance means comprises a pair of dice, and b. wherein said chance cards are picked by a player depending upon certain numbers obtained by said pair of dice.

27. A presidential election game as in claim 26, wherein a. said dice are coded with one die corresponding to said pathways of said first group as well as one said set of said first and second lanes, and b. said other die corresponds to said pathways of said second group as well as the other one of said set of said first and second lanes, such that movement of said marker by each player through said pathways and said lanes is dependent on said pair of dice.

28. A presidential election game as in claim 20, a. said zones are divided into different color designated groups, b. indicating mean available to each player that calculates the number of votes the player has obtained on the player's usage of said chance means, and c. said indicating means being in the form of a card that matches the color groups of said zones, said card being identical as the color groups on said playing board with basic multiples of votes assigned to each group, such that these basic multiples are matched with the number of player obtains by said chance means and as a result the player is given a total vote count obtained on usage of said chance means.

29. A presidential election game as in claim 28, said indicating means being provided in different multiples to as to vary the average time to finish the game.

30. A presidential election game as in claim 20, including a. roulette means operatively associated with said playing board and utilized by a player depending upon certain numbers obtained by said chance means, b. money distributed to each of the players at the start of the game for use in conjunction therewith, and c. distinguishable chips distributed to each of the players at the start of the game for use in conjunction therewith, said chips being placed upon a voting area that has been won by a player.

* * * * *